US008776421B1

(12) United States Patent
Vesligaj

(10) Patent No.: US 8,776,421 B1
(45) Date of Patent: Jul. 15, 2014

(54) SHOULDER STOCK ADAPTER FOR A HANDGUN

(71) Applicant: Zeljko Vesligaj, Wilmington, NC (US)

(72) Inventor: Zeljko Vesligaj, Wilmington, NC (US)

( * ) Notice: Subject to any disclaimer, the term of this patent is extended or adjusted under 35 U.S.C. 154(b) by 0 days.

(21) Appl. No.: 14/153,511

(22) Filed: Jan. 13, 2014

Related U.S. Application Data

(62) Division of application No. 13/948,309, filed on Jul. 23, 2013, now Pat. No. 8,677,669.

(51) Int. Cl.
*F41A 21/00* (2006.01)
*F41C 23/12* (2006.01)
*F41C 23/04* (2006.01)

(52) U.S. Cl.
CPC ..... *F41C 23/12* (2013.01); *F41C 23/04* (2013.01)
USPC ..... 42/71.02; 42/75.01

(58) Field of Classification Search
CPC ..... F41C 23/12; F41C 23/04
USPC ..... 42/75.01–75.1, 71.01–73
See application file for complete search history.

(56) References Cited

U.S. PATENT DOCUMENTS

| | | | |
|---|---|---|---|
| 1,276,572 | A | 8/1918 | Rogers |
| 1,477,445 | A | 12/1923 | Petritsch |
| 3,685,194 | A | 8/1972 | Coon |
| 3,798,818 | A | 3/1974 | Casull |
| 3,861,273 | A | 1/1975 | Seidel et al. |
| 4,271,623 | A | 6/1981 | Beretta |
| 4,291,482 | A | 9/1981 | Bresan |
| 4,513,523 | A | 4/1985 | Gal |
| 4,989,358 | A | 2/1991 | Aronson et al. |
| 5,092,070 | A | 3/1992 | Perkins |
| 5,761,842 | A | 6/1998 | Mantymaa |
| 5,924,233 | A | 7/1999 | Strobel |
| 6,367,187 | B2 | 4/2002 | Bubits |
| 6,553,707 | B1 | 4/2003 | Tseng |
| 6,729,061 | B1 | 5/2004 | DeJarnette, Jr. |
| 8,438,771 | B1 | 5/2013 | Boone |
| 8,505,226 | B2 | 8/2013 | Vesligaj |
| 2006/0162222 | A1 | 7/2006 | Beretta |
| 2008/0060247 | A1 | 3/2008 | Thomele et al. |
| 2010/0154272 | A1 | 6/2010 | Lamm |
| 2010/0186276 | A1 | 7/2010 | Herring |
| 2011/0107644 | A1 | 5/2011 | Faifer |
| 2012/0042556 | A1 | 2/2012 | Vesligaj |
| 2012/0131829 | A1 | 5/2012 | Fistikchi et al. |
| 2012/0260552 | A1 | 10/2012 | Vesligaj |

*Primary Examiner* — Michael David
(74) *Attorney, Agent, or Firm* — MacCord Mason PLLC

(57) ABSTRACT

An adapter is described for use in attaching a shoulder stock to a handgun with a bottom opening handgrip recess. The adapter includes an upright member having upper and lower ends and a longitudinal slot to attach a stock. A lower arm extends forward from the upright member lower end, and a brace arm extends forward from the upright member upper end. A recess insert extends upwardly from the distal end of the lower arm. A latching member releasably secures the insert in the handgrip recess. Also described is a grip plate module to replace the grip plates on a handgun handgrip that does not include a recess. The module includes first and second replacement grip plates for attachment in place of the original grip plates, and a replacement grip plate connector extending between the replacement grip plates. The connector includes a bottom opening recess to receive an adapter insert.

4 Claims, 4 Drawing Sheets

SHOULDER STOCK ADAPTER FOR A HANDGUN

BACKGROUND OF THE INVENTION (1) Field of the Invention

The present invention relates generally to an adapter to attach a tactical shoulder stock to a handgun such as a Glock brand handgun that has a recess or cavity with a bottom opening in the rear of the handgun grip. The invention also relates to replacement handgrips that include a cavity with a bottom opening for aftermarket mounting on original equipment handguns that do not have a grip cavity with a bottom opening to enable attachment of a shoulder stock adapter.

(2) Description of the Prior Art

Glock semi-automatic pistols, sometimes referred to by the manufacturer, Glock Ges.m.b.H., as Glock "Safe Action" Pistols, include a recess in the handgrip behind the magazine with an opening into the recess in the bottom of the handgrip. Glock models with this recess include models: G17, G18, G20, G21, G22, G24, G31, G34, G35 and G37.

This recess has been previously used to attach an adapter to the pistol, thereby enabling attachment of a tactical shoulder stock, such as an AR-15, M-16 or M4 tactical stock comprised of a buffer tube slidable within a buttstock having a locking mechanism to lock the buffer tube at selected positions relative to the buttstock. Attachment of the stock converts the pistol into a shoulder fired firearm. Some prior art adapters also include a brace having a distal end pressed against the rear handgrip projection that rests on the top of the shooter's hand.

Existing adapters allow longitudinal adjustment of the stock by sliding the buffer tube in or out relative to the buttstock. However, the stock is fixed relative to the pistol, so there is no possibility to vertically adjust the stock relative to the pistol. In addition, current adapters are of a fixed configuration, being designed for a particular pistol configuration, thereby requiring purchase of a completely different adapter for each pistol design. An adapter permitting vertical adjustment of the stock relative to the pistol would be of considerable value in adjusting the stock to suit shooters of different physical dimensions. An adapter that could be used with different pistols would also be of value.

Moreover, current adapters are only designed for attachment to glock pistols and are not attachable to pistols that do not include a recess extending upwardly into the pistol's handgrip. A means for modifying pistols other than glocks to enable mounting of tactical stocks would also find considerable utility.

SUMMARY OF THE INVENTION

The present invention addresses these deficiencies in prior art adapters by providing an adapter that permits horizontal adjustment of an attached stock. In addition, the invention provides a replacement grip plate module that includes a recess so that adapters previously useful only on glock pistols can also be used on other pistols.

Generally, the adapter of the present invention is comprised of a generally upright member with upper and lower ends attachable intermediate its upper and lower ends to the front end of a tactical stock buffer tube, a lower, generally horizontal arm extending forward from the lower end of the upright member, and a brace arm extending forward above the lower arm from the upper end of the upright member.

The upright member includes a longitudinally aligned slot to receive a threaded connector rod that extends from the forward end of the buffer tube and through the slot. A nut is threaded onto the distal end of the rod. Upon tightening, the nut frictionally engages the front of the upright member, preventing movement of the rod within the slot. However, upon loosening the nut, the rod, and thereby the stock, can be moved vertically. When the desired position of the stock relative to the upright member is reached, the nut is again tightened. Preferably, the nut is knurled and of a size such that it can be turned with the fingers.

To prevent rotation of the buffer tube relative to the adapter, the upright member also includes a longitudinal recess in its rear face that is aligned with, and of a greater length than the slot receiving the rod. The front of the buffer tube includes a vertical projection sized to fit within the recess. When fully inserted, the front face of the buffer tube abuts the rear face of the upright member, with the projection riding in the recess and the rod extending through the slot. As the buffer tube is adjusted relative to the adapter, the projection rides up or down in the recess as the rod moves up or down in the slot. Upon adjustment, the nut is tightened so that the front of the buffer tube frictionally engages the back face of the upright member.

A recess insert sized for insertion into the pistol handgrip recess is detachably attached to the forward end of the lower arm, extending generally and forward at an angle for insertion into the recess. The insert may be releasably attached to the lower arm with threaded bolts. The adapter may include a plurality of different sized and shaped inserts, with each insert being adapted for insertion into the handgrip recess of a particular model of pistol, thereby enabling modification of the adapter for different sizes and shapes of pistols.

A brace arm is releasably attached at its proximal end to the upper end of the upright member, with the brace arm extending forward and at a desired angle above horizontal. The distal end of the brace arm includes a recess for insertion of the rear handgrip projection that extends rearwardly from the upper end of the handgrip. In order to use the adapter on different glock models, a plurality of braces of different sizes and shapes may be provided so that the appropriately sized brace can be attached to the upright member.

The lower arm also includes a latching member comprised of a longitudinally aligned, spring loaded plunger that is urged forward into a bore in the rear of the insert. A gripping handle is attached to the rear of the plunger so that the user can withdraw the distal end of the plunger from the insert bore. Preferably, the handle is rotatable so that the handle can be rotated so that the front face of the handle engages the rear face of the upright member, preventing the plunger from returning to its forward position.

The stock may be of various configurations, but generally will include a connector, which may be a tube or rod, a buttstock that includes a conduit for slidably receiving the connector and a latching means to lock the connector in selected positions relative to the buttstock, thereby changing the length of the stock to meet the physical requirements and preferences of the user. The buttstock can be designed to have the appearance of stocks used on combat weapons or a conventional shotgun stock, known as a sporter stock.

The rear segment of the connector is slidable within the conduit in the buttstock between a fully inserted position and a fully extended position. Means is provided for securing the connector at selected positions in the conduit, thereby changing the length of the stock assembly. For example, the connector tube may include a plurality of transverse holes or recesses longitudinally aligned along one side, with the buttstock including a retractable latching member, e.g., a pin or set screw, that is insertable into a selected hole to lock the tube and buttstock in the desired relationship.

Glock pistols include a hole in the rear of the handgrip near the bottom of the handgrip. The hole extends from the exterior of the handgrip to the recess behind the magazine. The components of the adapter are sized so that the hole in the handgrip aligns with the bore in the insert when the insert is fully inserted into the handgrip recess. Upon extension, the latching rod extends through the handgrip hole and into the bore.

To attach the adapter to the pistol and the stock to the adapter, the plunger is retracted. The insert is fully inserted into the handgrip recess and the brace is slightly flexed to position the recess in the distal end of the brace against the tip of the rear handgrip projection. The latching plunger is then released to move the plunger to its forward position, extending through the handgrip rear hole and into the insert bore, thereby latching the adapter to the handgrip.

The stock is attached to the rear face of the adapter upright member by inserting the rod extending from the front of the connector through the slot in the upright member. The stock is then moved up or down to the desired position. The knurled nut is then hand tightened to secure the front end of the connector against the rear face of the upright member and the nut against the front face of the upright member, thereby locking the stock to the adapter. The locking pin can be disengaged from the connector so that the connector can be moved to the desired extension relative to the buttstock.

While the adapter is suitable for use with glock pistols due to their handgrip recess, use with other types of pistols has not heretofore been possible. The present invention also provides for a module for use in modifying other pistols so that the adapter can be used with non-glock pistols.

Pistol handgrips include grip plates on either side of the handgrip that are held to the handgrip by screws. In accordance with the present invention, these grip plates are replaced by a plate module that not only replaces the original left and right grip plates, but also includes a center section between the rear edges of the grip plates. The center section and grip plates may be integrally formed, e.g., by injection molding. The center section includes a bottom opening recess similar in configuration to the recesses found on glock pistols. In use, the original grip plates are removed from the pistol and the module is slid onto the hand grip so that the center section is against the rear of the pistol handgrip and the module's left and right grip plates are in the position of the original grip plates. Screws are then inserted into the original screw holes to attach the module to the handgrip. The adapter can then be attached in the same manner as described above.

DETAILED DESCRIPTION OF THE INVENTION

Figure 1:
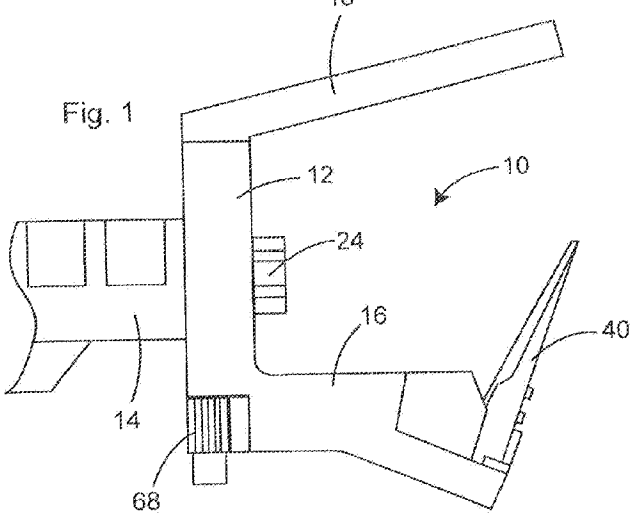
FIG. 1 is a side view of the adapter.
Figure 2:
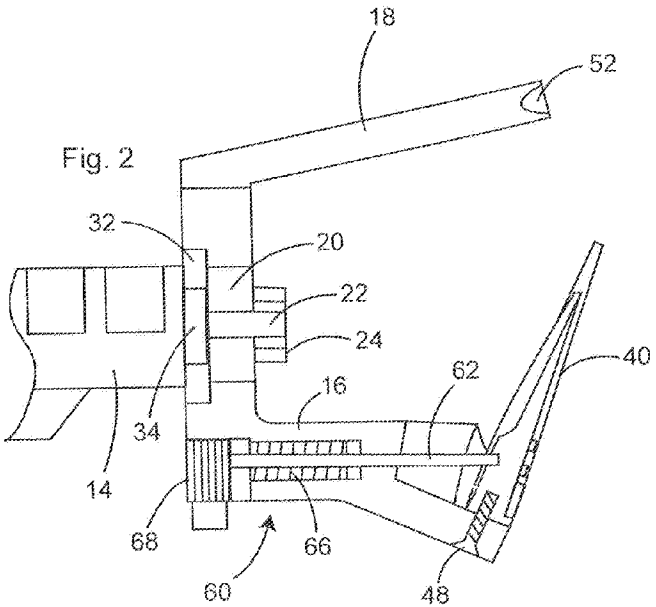
FIG. 2 is a partial sectional side view of the adapter.

In the following description, terms such as horizontal, upright, vertical, above, below, beneath, and the like, are used solely for the purpose of clarity in illustrating the invention, and should not be taken as words of limitation. The drawings are for the purpose of illustrating the invention and are not intended to be to scale.

As illustrated in the drawings, adapter, generally 10, is comprised of a generally upright member 12 with upper and lower ends attachable intermediate its upper and lower ends to the front end of tactical stock buffer connector 14, a lower, generally horizontal lower arm 16 extending forward from the lower end of upright member 12, and a brace arm 18 extends forward above lower arm 16 from the upper end of upright member 12.

Upright member 12 includes a longitudinally aligned slot 20 to receive a threaded connector rod 22 extending from the forward end of buffer connector 14 and through the slot. A hand-turned nut 24 is threaded onto the distal end of rod 22. Upon tightening, nut 24 frictionally engages the front of upright member 12, preventing movement of rod 22 within slot 20. However, upon loosening nut 24, rod 22, and thereby stock 30, can be moved vertically relative to adapter 10. When the desired position of the stock is reached, nut 24 is again tightened. Preferably, nut 24 is knurled of a size such that it can be turned with the fingers.

To prevent rotation of connector 14 relative to adapter 10, upright member 12 also includes a longitudinal recess 32 in its rear face that is aligned with, and of a greater length than slot 20. The front of connector 14 includes a vertically elongated projection 34 sized to fit within recess 32. When fully inserted, the front face of the connector 14 abuts the rear face of upright member 14, with projection 34 riding in recess 32 and rod 22 extending through slot 20. As connector 14 is adjusted relative to adapter 10, projection 34 rides up or down in recess 32 as rod 22 moves up or down in slot 20. Following vertical adjustment, nut 24 is tightened so that the front of the connector 14 frictionally engages the back face of upright member 12.

Figure 4:
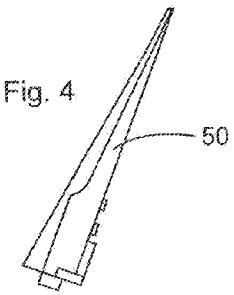
FIG. 4 is a side view of an alternative insert.
Figure 5:
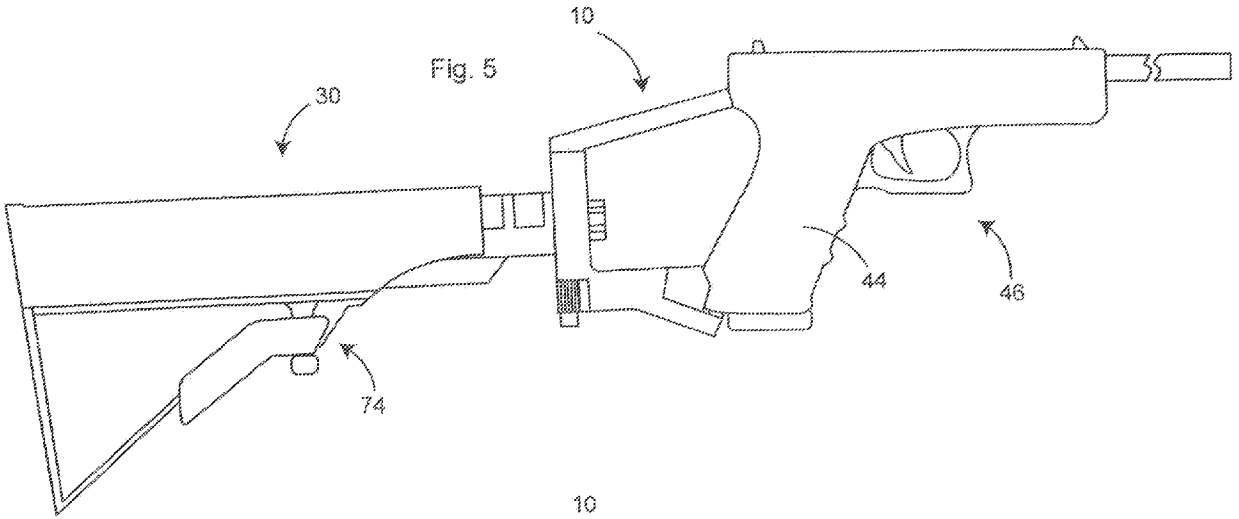
FIG. 5 is a side view of the adapter attaching a stock to a glock pistol.
Figure 6:
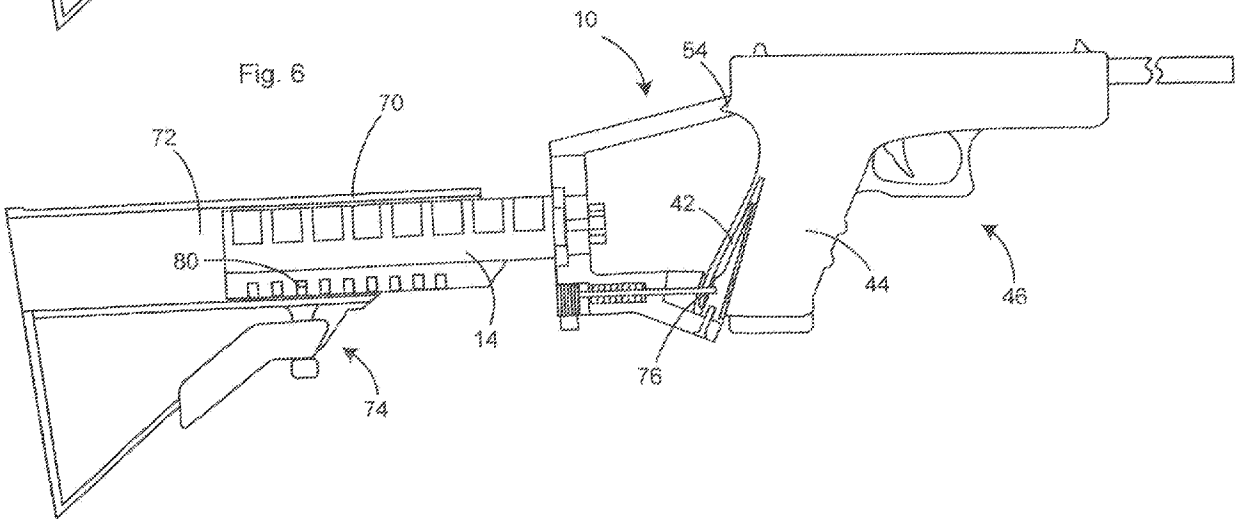
FIG. 6 is a partial sectional side view of the adapter attaching a stock to a glock pistol.
Figure 8:
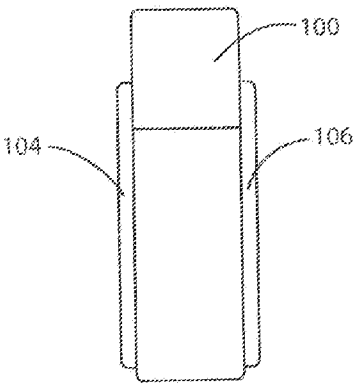
FIG. 8 is a rear view of the pistol of FIG. 7.
Figure 11:
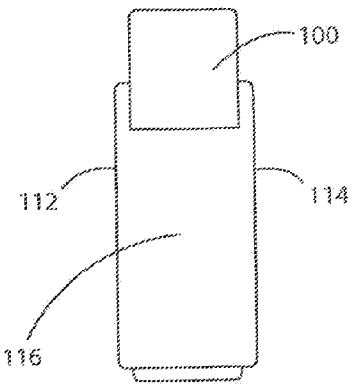
FIG. 11 is a rear view of the pistol of FIG. 10.
Figure 9:
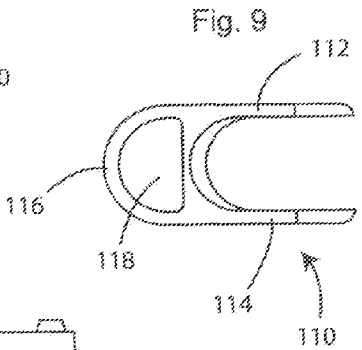
FIG. 9 is a bottom view of a module to adapt the pistol of FIGS. 7 and 8 and attachment to the adapter.

A recess insert 40 sized for insertion into the recess 42 in handgrip 44 of pistol 46 is detachably attached to the forward end of lower arm 16, extending generally and forward at an angle for insertion into recess 42. Insert 40 may be releasably attached to lower arm 16 with threaded bolts 48. Adapter 10 may include a plurality of different sized and shaped inserts, with each insert being adapted for insertion into the handgrip recess of a particular model of pistol. An alternative insert 50 which is longer than insert 40 is illustrated in FIG. 4. It will be understood that insert 50 is merely illustrative and that other insert shapes and sizes are contemplated.

Figure 3:
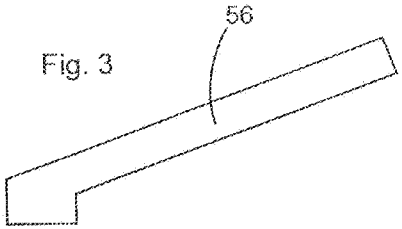
FIG. 3 is a side view of an alternative brace.

Brace 18 is releasably attached at its proximal end to the upper end of upright member 12, extending forward and at a desired angle above horizontal. The distal end of brace arm 18 includes a recess 52 for insertion of rear handgrip projection 54 that extends rearwardly from the upper end of handgrip 44. In order to use adapter 10 on different glock models, a plurality of braces of different sizes and shapes may be provided so that the appropriately sized brace can be attached to the upright member. An alternative brace 56 which is higher and longer than brace 18 is illustrated in FIG. 3. It will be understood that brace 56 is merely illustrative and that other brace shapes and sizes are contemplated.

Lower arm 16 also includes a latching member, generally 60, comprised of a longitudinally aligned plunger 62 urged forward into a bore 64 in the rear of insert 40 by spring 66. A gripping handle 68 is attached to the rear of plunger 62 so that the user can withdraw the distal end of plunger 62 from bore 64. Preferably, handle 68 is rotatable so that handle 68 can be rotated to engage the rear face of the upright member 12, preventing plunger 62 from returning to its forward position.

Stock 30 may be of various configurations, but generally will include connector 14, which may be a tube or rod, a buttstock 70 that includes a conduit 72 for slidably receiving connector 14 and a latching means 74 to lock connector 14 in selected positions relative to buttstock 70, thereby changing the length of stock 30 to meet the physical requirements and preferences of the user.

Pistol 46 includes a hole 76 in the rear of handgrip 44. Hole 44 extends from the exterior of handgrip 44 to 42. The components of adapter 10 are sized so that hole 76 aligns with bore 64 when insert 40 is fully inserted into handgrip recess 42. Upon extension, the latching plunger 62 extends through hole 76 and into bore 64.

To attach adapter 10 to pistol 46 and stock 30 to adapter 10, plunger 62 is first retracted. Insert 40 is then fully inserted into recess 42 and brace 18 is slightly flexed to position recess 52 against the tip of rear handgrip projection 54. Plunger 62 is then released to its forward position, extending through the handgrip rear hole 76 and into insert bore 64, thereby latching adapter 10 to pistol 46.

Stock 30 is attached to the rear face of adapter upright member 12 by inserting rod 22 through slot 20. Stock 30 is then moved up or down to the desired position relative to adapter 10. Knurled nut 24 is then hand tightened to secure the front end of connector 14 against the rear face of upright member 12 and nut 24 against the front face of upright member 12, thereby locking stock 30 to adapter 10.

While adapter 10 is suitable for use with glock pistols due to their inclusion of a handgrip recess, use with other types of pistols has not heretofore been possible. The present invention also provides for module that can be used to modify other pistols so that the adapter can be used.

Figure 7:
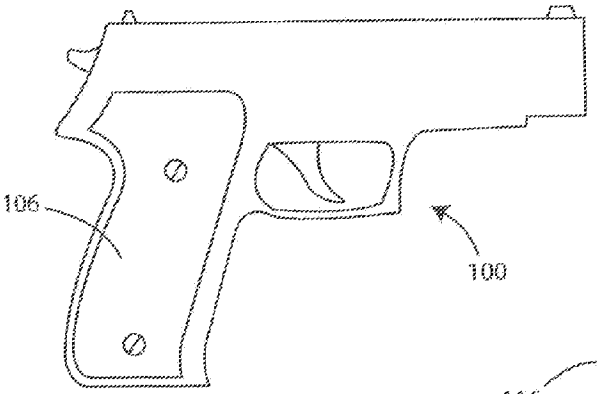
FIG. 7 is a side view of a typical automatic pistol without a handgrip recess.
Figure 10:
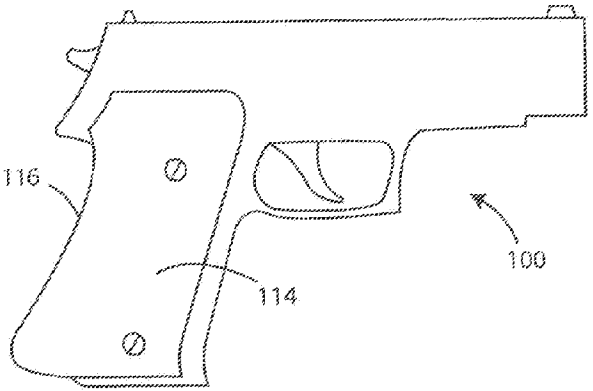
FIG. 10 is a side view of the pistol of FIG. 7 with the original grip plates replaced by the module of FIG. 9.
Figure 12:
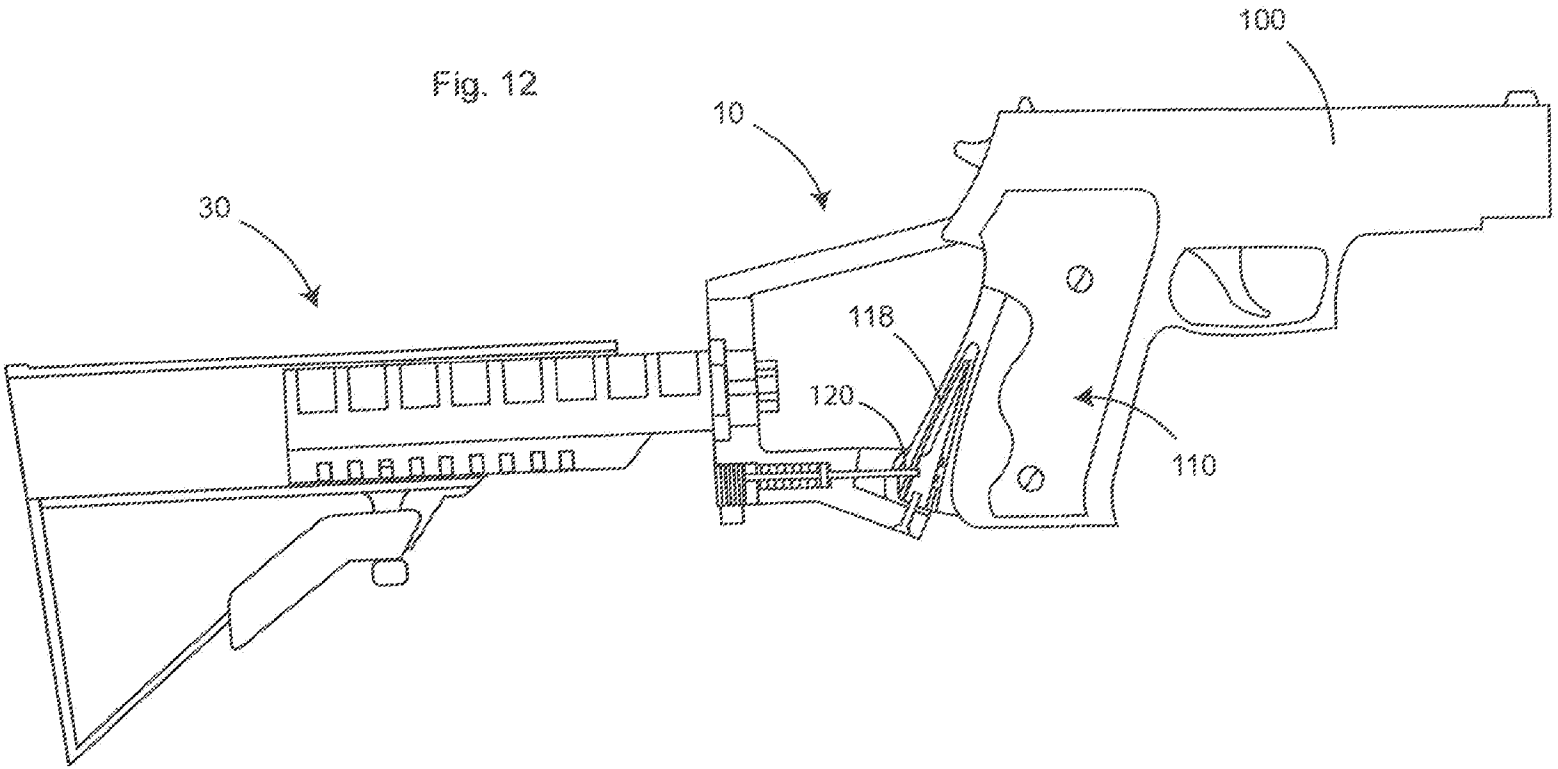
FIG. 12 is a partial sectional side view of the pistol of FIG. 10 joined to a stock by with the adapter.

Pistol 100 illustrated in FIG. 7 is representative of a pistol that does not include a handgrip recess as originally manufactured, Pistol 100 includes a handgrip 102 with grip plates 104 and 106 that are releasably attached to handgrip 102 by screws 108. In accordance with the present invention, grip plates 104 and 106 are replaced by a plate module 110 that not only replaces the original grip plates 104 and 106 with grip plates 112 and 114, but also includes a center section 116 between the rear edges of grip plates 112 and 114. Center section 116 includes a bottom opening recess 118 similar in configuration to the recesses found on glock pistols. Center section 116 also includes a rear hole 120 extending into recess 118 for insertion of a latching plunger.

In use, the original grip plates 104 and 106 are removed from pistol 100 and module 110 is slid onto handgrip 102 so that the front of center section 116 is against the rear of handgrip 102, and left and right grip plates 112 and 114 are in the position of original grip plates 104 and 106. Screws 108 are then inserted into the original screw holes to attach module 116 to handgrip 102. Adapter 10 can then be attached in the same manner as described above.

Certain modifications and improvements will occur to those skilled in the art upon a reading of the foregoing description. It should be understood that all such modifications and improvements have been deleted herein for the sake of conciseness and readability but are properly within the scope of the following claims.

What is claimed is:

1. A grip plate module to replace the original grip plates on a handgun handgrip that does not include a bottom opening recess for attachment of a stock adapter comprising:

a) first and second replacement grip plates spaced for attachment in place of said original grip plates, said replacement grip plates having rear edges; and b) a replacement grip plate center section between the rear edges of said replacement grip plates, said center section including an upwardly extending, bottom opening recess sized to receive an adapter recess insert.

2. The module of claim 1, wherein said replacement grip plates and center section are integrally molded.

3. The module of claim 1, wherein said handgrip has a rear face and said center section has a front face adapted for placement against said handgrip rear face.

4. The module of claim 1, wherein said center section includes a rear hole extending into said recess to receive a latching plunger.

* * * * *